US008069826B2

(12) United States Patent
Roos et al.

(10) Patent No.: US 8,069,826 B2
(45) **Date of Patent: *Dec. 6, 2011**

(54) SURFACE PASSIVATION AND THE METHODS FOR THE REDUCTION OF FUEL THERMAL DEGRADATION DEPOSITS

(75) Inventors: Joseph H. Roos, Mechanicsville, VA (US); Allen A. Aradi, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/957,632

(22) Filed: Dec. 1, 2010

(65) Prior Publication Data

US 2011/0126788 A1 Jun. 2, 2011

Related U.S. Application Data

(63) Continuation of application No. 11/860,363, filed on Sep. 24, 2007, now Pat. No. 7,878,160.

(51) Int. Cl.
*F02B 75/08* (2006.01)

(52) U.S. Cl. ..... 123/1 A; 123/668; 123/670

(58) Field of Classification Search ..... 123/1 A, 123/668, 670, 467
See application file for complete search history.

(56) References Cited

U.S. PATENT DOCUMENTS

| | | | | |
|---|---|---|---|---|
| 4,022,589 | A | 5/1977 | Alquist et al. | |
| 4,612,880 | A | 9/1986 | Brass et al. | |
| 5,534,081 | A * | 7/1996 | Takagi et al. | 148/325 |
| 5,928,392 | A | 7/1999 | Aradi | |
| 6,786,938 | B1 | 9/2004 | Cemenska et al. | |
| 6,881,235 | B2 | 4/2005 | May | |
| 7,553,343 | B2 | 6/2009 | Aradi | |
| 7,553,801 | B2 | 6/2009 | Alexander et al. | |
| 7,878,160 | B2 * | 2/2011 | Aradi et al. | 123/1 A |
| 2002/0017052 | A1 | 2/2002 | Hori et al. | |
| 2003/0213165 | A1 | 11/2003 | Aradi et al. | |
| 2004/0118032 | A1 | 6/2004 | Aradi et al. | |
| 2008/0284283 | A1 | 11/2008 | Kaspar et al. | |
| 2010/0001215 | A1 * | 1/2010 | Suzuki et al. | 251/129.01 |

FOREIGN PATENT DOCUMENTS

| | | |
|---|---|---|
| CN | 1392339 | 1/2003 |
| EP | 1840192 | 10/2007 |
| GB | 1218973 | 1/1971 |
| JP | 2000291437 | 10/2000 |
| WO | 2005087901 | 9/2005 |

OTHER PUBLICATIONS

China Patent Application No. 200810210033.3; Third Office Action Dated Aug. 17, 2011; 6 pages.
501067, RD, Jan. 10, 2006, Unknown.
Partial European Search Report; Application No. 08162901.6-2104/2042582; dated Dec. 18, 2009; 4 pages.
Second Office Action in China; Application No. 200810210033.3; date of issuance Dec. 6, 2010; 17 pages.
Examination Report of Intellectual Property Office in Singapore; Singapore Application No. 200805484-3; dated Sep. 29, 2010; 10 pages.
European Office Action, Serial No. 08162901.6-2104/2042582, 1 page, dated Dec. 18, 2009.
First Office Action Chinese Patent Office together with Text;Serial No. 200810210033.3; Date of Issue, Apr. 13, 2010; 16 pages.
Extended Search Report; European Application No. 08162901.6-2104/2042582; dated Mar. 8, 2010; 9 pages.
Written Opinion for Singapore Patent Application 200805484-3; mailing date Sep. 28, 2009; 10 pages.

* cited by examiner

*Primary Examiner* — Hai Huynh
(74) *Attorney, Agent, or Firm* — Thomas & Karceski, P.C.

(57) ABSTRACT

In a specific embodiment of this invention, deposits and soot formation in a direct injection engine are reduced by passivating the injectors to within 0.1 mm of the injector nozzle. The fuel used with the inventive injectors comprises fuel-soluble additives.

18 Claims, No Drawings

SURFACE PASSIVATION AND THE METHODS FOR THE REDUCTION OF FUEL THERMAL DEGRADATION DEPOSITS

RELATED APPLICATIONS

This is a continuation application of application Ser. No. 11/860,363, filed Sep. 24, 2007 now U.S. Pat. No. 7,878,160, which is incorporated herein its entirety and U.S. patent application Ser. Nos. 10/149,303 (now U.S. Pat. No. 7,553, 343) and 10/148,947 (now abandoned) and are commonly owned with the present application and disclose numerous additives for hydrocarbon fuels that can be useful in the instant invention. These applications, however, do not suggest nor disclose the present invention which is directed to the selective passivation of metal components.

FIELD OF THE INVENTION

The present invention specifically relates to the passivation on the outside of fuel injectors and to methods to control coking or deposit formation on the injectors. The invention also relates to the use of fuel compositions and methods for controlling, i.e. reducing or eliminating, deposits on the injectors of direct injection gasoline (DIG) and diesel engines. More particularly, the invention relates to the discovery that coking or deposit growth initiates on the outside (combustion side) of the injector nozzle or opening and eventually moves into the nozzle. As a result of the discovery, passivation methods based on coatings and/or surface texturing need only be applied to the outside of the injector, in the vicinity of the nozzle. To preserve the passivation of the injectors, the fuel compositions combusted in the engines preferably comprise an additive, for example a detergent.

BACKGROUND OF THE INVENTION

Considerable work has been devoted to additives for controlling (preventing or reducing) deposit formation in the fuel induction systems of spark-ignition internal combustion and compression ignition (diesel) engines. In particular, additives to control fuel injector deposits, intake valve deposits and combustion chamber deposits is the focal point of a considerable amount of prior art. Despite these efforts, further improvements are needed and highly desired.

Many people have experienced difficulty in starting their fuel injected cars and trucks. This is especially true when the engine is hot. One possible cause is that lacquers build up in the fine orifices and the filter of the fuel injector, which restricts the flow of fuel; this is termed injector fouling. Another cause of injector fouling is when particulate contamination lodges in the injector nozzle (pintle) and prevents effective shut-off of the engine. This is known as pintle leakage. Many additives have been developed to add to the fuel to reduce these problems; however, significant improvements in injector design can also be of benefit.

Fuel injector performance is at the forefront of the DIG combustion systems as it relies heavily on fuel spray consistency to realize its advantages in fuel economy and power, and to minimize exhaust emissions. A consistent spray pattern enables more precise electronic control of the combustion event and the exhaust after-treatment system.

There are numerous references teaching gasoline compositions (fuel chemistries) for controlling injector fouling, for example, fuels containing Mannich detergents are disclosed in U.S. Pat. Nos. 4,231,759; 5,514,190; 5,634,951; 5,697, 988; 5,725,612; and 5,876,468. However, none of these references teach the use of fuel compositions containing detergents for use in DIG or diesel engines with surface passivated injectors. These references also fail to suggest or disclose the surface texturing or passivation of the injector on the outside of the injector seat, in the vicinity of the nozzle which inhibits the formation of gum and/or coke, without adoption of special procedures and without installation of special equipment.

Little attention has, however, been given in the prior art to the role of the physical treatment of the engine components that come into contact with the fuel. For example, U.S. Pat. No. 3,157,990 discloses that certain phosphate additives are combined with the fuel which decompose in the combustion chamber and form a coating, probably a phosphate coating, on the internal engine surfaces. It is suggested that this coating effectively inhibits carbon deposit formation. Further, in U.S. Pat. No. 3,236,046 the interior surface of stainless steel gas generators is passivated with sulfurous materials to overcome deposition of coke on the surfaces of the gas generator. Passivation in this reference was defined as a surface treatment of an engine component which substantially reduces coke formation.

In view of the foregoing, it can be seen that it would be desirable to provide surface passivated and/or textured engine components (e.g., fuel containment articles and fuel injectors) so that deposit formation is avoided, eliminated or reduced. The disadvantages of the prior art processes and techniques include increased costs and promote uncertainty. It is a primary objective of this invention to overcome these disadvantages.

SUMMARY OF THE INVENTION

As used herein and in the claims the terms "passivate", "passivated", "passivation" and "passivating" are interchangeable and mean "to make inactive or less reactive". These terms also mean "to protect (as a solid-state device) against contamination by coating or surface treatment".

Passivation can take many forms including chemical coatings, mechanical surface texturing, chemical surface texturing, laser sputtering, micromachining, ion-beam sputter etching and combinations thereof. One very new passivation technique is a coating on the surfaces with nanoparticles or nano alloys. This is another way of achieving texturing. The nanoparticles and nanoalloys may be made according to well known methods and deposited as a film to the surface, again according to well known methods. The advantage with this method is that one may achieve texturing and/or surface activity that promotes carbon oxidation at lower temperatures and hence destroys deposit precursors before they convert to intractable deposits. Metals in such nanoparticles may include alkali metals (Li, Na, K, Rb, etc), alkaline earth metals (Mg, Ca, Sr, Ba, etc), transition metals (Ti, Cr, Mn, Fe, Co, Ni, Cu, Zn, Zr, Mo, Ru, Rh, Pd, Hf, Ta, W, Re, Os, Ir, Pt, Ag, Au, etc) actinides and lanthanides (La, Y, Ac, Ce, Pr, Nd, Gd, Tb, etc), and mixtures thereof. This is generally known as nano-texturing and is part of passivation as used herein and in the claims.

As used herein, "hydrocarbon fluid" and "hydrocarbon fuel" are defined as one or more hydrocarbon liquids, hydrocarbon gases or mixtures thereof. As used herein, "hydrocarbon fluid degradation products" or "thermal degradation products" includes products which form from the hydrocarbons, for example, certain polymers resulting from thermal transformation of paraffin to cycloparaffin, aromatics and polycyclic molecules in the hydrocarbon, as well as products which result from actual decomposition of the fuel, e.g., carbon. This is sometimes referred to as fuel instability. The hydrocarbon fluids include gasoline, diesel fuel, lubricating oils; hydraulic oils and combustible fuels form gum and coke deposits on the surface of the metal parts which they contact (deposits). The terms hydrocarbon fluid, hydrocarbon fuel and distillate fuel may be used interchangeably herein. The invention has applicability to any hydrocarbon fluid or fuel in which gum, coke and/or sulfur compounds form when the fluid is exposed to heat. Although the invention is not directed to or limited by any particular hydrocarbon fluid or hydrocarbon fuel, typical fuels may also include natural gas and hydrocarbons and distillation products thereof which are generally liquid at room temperature. The fluids may be mixtures of hydrocarbons, mixtures of such distillation products, mixtures of hydrocarbons and distillation products, gasoline, No. 1 or No. 2 diesel fuels, jet engine fuels, such as Jet-A fuel. Other articles for containing or contacting hot hydrocarbon fluids can benefit from the present invention and include fuel storage tanks, conduits for transporting liquid fuel and the like.

As used herein and in the claims the terms "fuel injection", "injectors" and injection" are interchangeable and relate to a means of metering fuel into an internal combustion engine. The fuel injector is comprises at least a nozzle and a valve. The power to inject the fuel comes from a pump or a pressure container further back in the fuel system.

One aspect of the present disclosure resides in the discovery that the physical treatment of the engine components that come into contact with the fuel can have a major influence on deposit mechanisms and deposit rates. Another aspect of the disclosure relates to the discovery that injector deposits grow from the outside of the injector, against the direction of the fuel flow, and into the nozzle of the injector.

These and other disadvantages are overcome in accordance with the present disclosure by providing passivation to a surface of an engine component that comes into contact with the hydrocarbon fluid, wherein in one embodiment a portion of said component is passivated, which provides a savings in cost and production time. More specifically, the present disclosure also presents the discovery that deposits begin on the outside (combustion side) of the injector nozzle and progresses into the nozzle. Thus, one aspect presented herein resides in the use of passivation techniques that are only applied on the outside of the injector, in the vicinity of the nozzle.

Thus, there is disclosed a method for controlling deposit formation on metal parts of an internal combustion engine, said method comprising the steps of: a) passivating one or more metal parts subject to deposit formation in said internal combustion engine; and b) introducing into said internal combustion engine a fuel composition comprising at least one fuel soluble additive. The passivation is a process selected from the group consisting of coatings, surface texturing and combinations thereof; and said additive(s), in a preferred embodiment, comprises a fuel soluble detergent/dispersant formulated from (Mannichs, PIB Amines, Polyetheramines, Succinimides, or combinations thereof). Another additive embodiment comprises a fuel soluble cyclomatic manganese tricarbonyl compound in proportions effective to reduce the amount of deposits in said internal combustion engine compared to a fuel that is devoid of a fuel-soluble cyclopentadienyl manganese tricarbonyl compound. Another embodiment of the present disclosure comprises a method for reducing soot loading in the crankcase lubricating oil of a vehicle having a fuel injected engine having injector surfaces which method comprises introducing onto the outside of the injector surfaces passivation selected from coatings, surface texturing and combinations thereof.

More specifically, the present disclosure is directed to a method for controlling injector coking in DIG and diesel injectors by applying on the outside of the injector a surface treatment selected from the group consisting of: passivating chemical coatings, mechanical surface texturing, chemical surface texturing, laser sputtering, micromachining, ion-beam sputter etching and combinations thereof. The surface treatment does not enter the injector nozzle and is preferably within 0.1 to 2.0 mm of the injector nozzle.

The fuel is preferably a blend of hydrocarbons of the gasoline boiling range and a fuel-soluble oxygenated compound. Another embodiment herein comprises a method for reducing soot loading in the crankcase lubricating oil of a vehicle having a fuel injected engine having injector seat surfaces which method comprises introducing onto the outside of the injector seat surface passivation selected from coatings, surface texturing and combinations thereof.

Passivation or surface treatment is selected from the group consisting of: passivating chemical coatings, mechanical surface texturing, chemical surface texturing, laser sputtering, nano-technology, micromachining, ion-beam sputter etching and combinations thereof. The surface treatment does not enter the injector nozzle and is preferably within 0.1 to 2.0 mm of the injector nozzle. As discussed previously, the passivation is applied to the outside of said injector which does not include the injector nozzle. In a more preferred embodiment the passivation is applied to within 1.0 to 2M mm of said injector nozzle.

There is also disclosed a method for reducing deposit formation on the fuel injectors of an injected internal combustion engine, said method comprises the steps of: a) passivating metal parts subject to deposit formation in said internal combustion engine, wherein said passivating comprises a process selected from the group consisting of coatings, surface texturing, nano-technology and combinations thereof; and b) introducing into said internal combustion engine a fuel composition comprising at least one fuel soluble additive, wherein said additive is or comprises at least one additive selected from the group consisting of detergents, dispersants, antioxidants, carrier fluids, metal deactivators, dyes, markers, corrosion inhibitors, biocides, antistatic additives, drag reducing agents, demulsifiers, dehazers, anti-icing additives, antiknock additives, anti-valve-seat recession additives, lubricity additives, combustion improvers and mixtures thereof.

Further there is disclosed a fuel injected internal combustion engine wherein said engine: a) combusts a fuel which comprises a blend of hydrocarbons of the gasoline boiling range and at least one additive selected from the group consisting of detergents, dispersants, antioxidants, carrier fluids, metal deactivators, dyes, markers, corrosion inhibitors, biocides, antistatic additives, drag reducing agents, demulsifiers, dehazers, anti-icing additives, antiknock additives, anti-valve-seat recession additives, lubricity additives, combustion improvers and mixtures thereof; and b) wherein said engine comprises injectors, said injectors being treated by passivation to within 0.1 mm of the nozzle.

The surface texturizing or passivation is conducted on the engine metal components, also referred to as a substrate that is subject to deposit formation. The present disclosure in one embodiment overcomes the limitations of the prior art as discussed above by providing a relatively inexpensive method which eliminates or reduces the deposits from hydrocarbon fuels. There is also disclosed an injected internal combustion engine that contains the claimed passivated components.

In accordance with one example of the present disclosure, there is provided a method for reducing the deposit of degradation products and/or thermal instability deposits from hot hydrocarbon fluids on a metal substrate, wherein the method comprises passivating the substrate to within 0.1 mm, more preferably within 2.0 mm of the port, nozzle or nozzle of the substrate.

The term "nozzle" and "injector nozzle" as used herein and in the claims means the hole or port through which the hydrocarbon fuel flows. The nozzle is the opening in the metal substrate which is most susceptible to deposit formation, which results in a decrease in efficiency. Nozzles are also found in heat exchangers, fuel containment devices and lubrication systems. Thus, for example, fuel is pumped through the nozzle of a heat exchanger and combusted. In similar fashion, the injector nozzle or hole in a DIG engine will cause difficulties when fouled. The present disclosure protects the nozzle from fouling or the build up of deposits in the nozzle which reduce its efficiency.

DETAILED DISCLOSURE OF THE INVENTION

The present inventors have studied the mechanism of injector fouling and have found that the initial deposit formation is critical in anchoring the deposit on the injector. The initiation occurs on the outside of the injector nozzle, and within millimeters of the nozzle. It then grows around the lip and into the nozzle. This discovery makes passivation methods much more practical because they need only be applied in a limited area around the nozzle.

Numerous methods for surface texturing or passivation to introduce microscopic unevenness are known, and on the nano level may include laser sputtering, micromachining and controlled chemical etching. Other methods of achieving the same include ion-beam sputter deposition of thin-film coatings and ion-beam sputter etching. In a further embodiment of the invention, laser surface texturing (LST) is used on the metal component. LST greatly increases the surface area across the metal component with features down to 0.002 inches (about 0.005 cm). Further, no masks are required and the style of the pattern can be directly imported from CAD (computer assisted design) files. Representative LST is available from MLPC Inc. of Miamisburg, Ohio 45342. LST provides a unique method for applying passivation to metals, ceramics and polymers. The process uses a laser to selectively remove material from the surface of a part to create a desired geometry.

Further, numerous publications such as the journal NANOTECHNOLOGY, discuss methods to prepare and use nano particles. The application of nano technology in this invention can be used by: 1) directly surface texture by applying the nanoparticles to the surface of the substrate by vapor phase deposition, and/or 2) place the nanoparticles in a special polymer matrix, apply the matrix to the surface of the substrate and then burn off the polymer, and/or 3) use a polymer matrix that is stable under conditions of intended application, and/or 4) apply passivating or surface activating nanoparticle chemistry to the treatments described in 1-3 above.

In the use of coating the substrates with metal nanoparticles or nano alloys as a way of achieving texturing the nanoparticles and nano alloys are made according to well known methods and deposited as a film to the substrate, again according to well known methods. The advantage with this method is that one may achieve texturing and/or surface activity that promotes carbon oxidation at lower temperatures and hence destroys deposit precursors before they convert to intractable deposits. Metals in such nanoparticles may include alkali metals (Li, Na, K, Rb, etc), alkaline earth metals (Mg, Ca, Sr, Ba, etc), transition metals (Ti, Cr, Mn, Fe, Co, Ni, Cu, Zn, Zr, Mo, Ru, Rh, Pd, Hf, Ta, W, Re, Os, Ir, Pt, Ag, Au, etc) actinides and lanthanides (La, Y, Ac, Ce, Pr, Nd, Gd, Tb, etc), and mixtures thereof.

For more information on passivation see http://www.mlpc-.com/surfacetexturing.html and http://www.grc.nasa.gov/WWW/epbranch/ThinFilms/dbeam.htm. Physical parameters of the surface texturing are optimized (for example, peak to valley height and peak to peak distance representing the topology of the textured surface) to maximize the contact angle of the fuel in the vicinity of the nozzle.

In one embodiment herein, the metal part (i.e. the injector body) can be fully coated and then the nozzle can be drilled. This drilling may be accomplished using conventional machining techniques or laser drilling.

Passivated surfaces of this invention may suffer from deposits that fill in the valleys and therefore minimize the effect of the passivation. Additive packages are typically necessary to inhibit this deposit formation. Representative additives include the Mannich-, PIB-Amine-, Polyetheramine- and succinimide-type, and mixtures thereof. In the effort to keep the passivated surface clean, additional conventional additives can be used, with the low molecular weight additives that go into the vapor phase readily, being the most preferred. The triazine, DMAPA and other small amines are also useful.

U.S. Pat. No. 6,800,103 B2 provides a good discussion of generic additive packages. These additive packages are well known in the art. The fuel additives are employed in amounts sufficient to reduce or inhibit deposit and/or soot formation compared to hydrocarbon fuels without such additive packages. Generally the fuel will contain an additive package at about 0.001 to about 1.0 gm of additive package per gallon of fuel, and preferably from about 0.01 to about 0.5 gram per gallon. Industry experts recommend levels of about 1,000 parts per million (ppm) of dispersant-detergent in the fuel, however, as much as 85% of the gasoline that is being sold today contains only one-tenth of the recommended dosage, or only about 100 ppm of the additive package. Consequently, using cheap gasoline contributes to the formation of injector deposits.

In one embodiment herein, the fuel additives that can be used include cyclopentadienyl manganese tricarbonyl compounds which include cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. Preferred are the cyclopentadienyl manganese tricarbonyls which are liquid at room temperature such as methylcyclopentadienylmanganesetricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc. Preparation of Such Compounds is Described in the Literature; See for Example, U.S. Pat. No. 2,818,417. One of the best additives are the polyetheramines.

The fuel compositions and additive packages useful in the present disclosure may, and typically do, contain amine detergents. Suitable amine detergents include hydrocarbyl succinic anhydride derivatives, Marmich condensation products, hydrocarbyl amines and polyetheramines. The hydrocarbyl-substituted succinic anhydride derivatives are known to those of skill in the art. See for example U.S. Pat. Nos. 3,361,673; 3,676,089; 3,172,892; 4,234,435; 5,620,486 and 5,393,309.

The hydrocarbyl substituents on the succinic anhydrides are generally derived from polyolefins that are polymers or copolymers of mono-olefins, particularly 1-mono-olefins, such as ethylene, propylene, butylene, and the like. Preferably, the mono-olefin employed will have 2 to about 24 carbon atoms, and more preferably, about 3 to 12 carbon atoms. More preferred mono-olefins include propylene, butylene, particularly isobutylene, 1-octene and 1-decene. Polyolefins prepared from such mono-olefins include polypropylene, polybutene, polyisobutene, and the polyalphaolefins produced from 1-octene and 1-decene. The preparation of such polyisobutenes in which the methylvinylidene isomer comprises a high percentage of the total composition is described in U.S. Pat. Nos. 4,152,499 and 4,605,808.

The hydrocarbyl succinimides are obtained by reacting a hydrocarbyl-substituted succinic anhydride, acid, acid-ester or lower alkyl ester with an amine containing at least one primary amine group. Representative examples are disclosed in U.S. Pat. Nos. 3,172,892; 3,202,678; 3,219,666; 3,272,746; 3,254,025, 3,216,936, 4,234,435; and 5,575,823. Especially preferred hydrocarbyl succinimides for use in the present invention are the products of reaction of a polyethylenepolyamine, e.g. triethylene tetramine or tetraethylene pentamine, with a hydrocarbon substituted carboxylic acid or anhydride made by reaction of a polyolefin, preferably polyisobutene, having a molecular weight of 500 to 2,000, especially 700 to 1500, with an unsaturated polycarboxylic acid or anhydride, e.g. maleic anhydride.

In another preferred embodiment herein, the amine is an aliphatic diamine having one primary or secondary amino group and at least one tertiary amino group in the molecule.

The Mannich base detergents useful in the present invention are the reaction products of an alkyl-substituted hydroxyaromatic compound, aldehydes and amines. The alkyl-substituted hydroxyaromatic compound, aldehydes and amines used in making the Mannich reaction products are known. The preparation of such compounds are disclosed in U.S. Pat. Nos. 4,152,499 and 4,605,808.

Suitable Mannich base detergents for use in the present invention are also taught in U.S. Pat. Nos. 4,231,759; 5,514,190; 5,634,951; 5,697,988; 5,725,612; and 5,876,468. Details for preparing aliphatic polyamine detergent/dispersants, can be found in U.S. Pat. Nos. 3,438,757; 3,454,555; 3,485,601; 3,565,804; 3,573,010; 3,574,576; 3,671,511; 3,746,520; 3,756,793; 3,844,958; 3,852,258; 3,864,098; 3,876,704; 3,884,647; 3,898,056; 3,950,426; 3,960,515; 4,022,589; 4,039,300; 4,128,403; 4,166,726; 4,168,242; 5,034,471; 5,086,115; 5,112,364; and 5,124,484; and published European Patent Application 384,086.

Polyetheramines suitable for use as the detergents in the present invention are preferably "single molecule" additives, incorporating both amine and polyether functionalities within the same molecule. The polyetheramines can be monoamines, diamines or triamines Examples of commercially available polyetheramines are those under the tradename Jeffamines™ available from Huntsman Chemical Company. The molecular weight of the polyetheramines will typically range from 500 to 3000. Other suitable polyetheramines are those compounds taught in U.S. Pat. Nos. 4,288,612; 5,089,029; and 5,112,364.

The base fuels used in formulating the fuel compositions of the present invention include any base fuels suitable for use in the operation of fuel injected engines such as leaded or unleaded motor gasoline, and diesel fuels. The fuels may also contain oxygenated blending agents ("oxygenates"), such as alcohols, ethers and other suitable oxygen-containing organic compounds. Oxygenates suitable for use in the present invention include methanol, ethanol, isopropanol, t-butanol, mixed C1 to C5 alcohols, methyl tertiary butyl ether, tertiary amyl methyl ether, ethyl tertiary butyl ether and mixed ethers. Oxygenates, when used, will normally be present in the base fuel in an amount below about 30% by volume, and preferably in an amount that provides an oxygen content in the overall fuel in the range of about 0.5 to about 5 percent by volume. The discovery of the present invention is also applicable to injected fuels that consist primarily of ethanol.

The detergents are preferably used with a liquid carrier or induction aid. Such carriers can be of various types, such as for example liquid poly-α-olefin oligomers, mineral oils, liquid poly (oxyalkylene) compounds, liquid alcohols or polyols, polyalkenes, liquid esters, and similar liquid carriers. Mixtures of two or more such carriers can be employed. The mineral oil carrier fluids that can be used include paraffinic, naphthenic and asphaltic oils, and can be derived from various petroleum crude oils and processed in any suitable manner. The poly-α-olefins (PAO) suitable for use as carrier fluids are the hydrotreated and unhydrotreated poly-α-olefin oligomers, i.e., hydrogenated or unhydrogenated products, primarily trimers, tetramers and pentamers of α-olefin monomers, which monomers contain from 6 to 12, generally 8 to 12 and most preferably about 10 carbon atoms. Their synthesis is outlined in *Hydrocarbon Processing*, February 1982, page 75 et seq., and in U.S. Pat. Nos. 3,763,244; 3,780,128; 4,172,855; 4,218,330; and 4,950,822. The poly (oxyalkylene) compounds which are among the preferred carrier fluids for use in this invention are fuel-soluble compounds having an average molecular weight of from about 500 to about 3000, more preferably from about 750 to about 2500, and most preferably from above about 1000 to about 2000. The poly (oxyalkylene) compounds, when used, pursuant to this invention will contain a sufficient number of branched oxyalkylene units (e.g., methyldimethyleneoxy units and/or ethyldimethyleneoxy units) to render the poly (oxyalkylene) compound gasoline and diesel fuel soluble. Suitable poly (oxyalkylene) compounds for use in the present invention include those taught in U.S. Pat. Nos. 5,514,190; 5,634,951; 5,697,988; 5,725,612; 5,814,111 and 5,873,917. Suitable polyalkenes for use in the present invention are taught in U.S. Pat. No. 6,048,373 issued on Apr. 11, 2000. When the carrier fluids are used in combination with the amine detergents, the ratio (wt/wt) of detergent to carrier fluid(s) is typically in the range of from 1:0.1 to 1:3. The use of a concentrate reduces blending time and lessens the possibility of blending errors.

EXAMPLE 1

Some of the practice and advantages of this invention are demonstrated by the following example which is presented for purposes of illustration and not limitation. To demonstrate the effectiveness of the passivation of the present invention in reducing deposits in direct injection gasoline engines, tests were conducted in a 1982 Nissan Z22e (2.2 liter) dual-spark-plug, four-cylinder engine modified to run in a homogeneous direct injection mode, at a fuel rich lambda of 0.8 to accelerate injector deposit formation. Details of this test (without the use of passivation) are disclosed in Aradi, A. A., Imoehl, B., Avery, N L., Wells, P. P., and Grosser, R. W.: "*The Effect of Fuel Composition and Engine Operating Parameters on Injector Deposits in a High-Pressure Direct Injection Gasoline (DIG) Research Engine*", *SAE Technical Paper* 1999-01-3690 (1999).

The fuel injectors were passivated by rinsing the injector seats three times with methylene chloride. The seats were then transferred from the methylene chloride to an oven. The oven was continuously purged with nitrogen at a rate of 250 mL/minute. The oven was then heated to 500° C. while continuing the flow of nitrogen. The temperature was held at 500° C. for 15 minutes and then cooled to 150° C. The injector seats were then transferred to a nitrogen purged test tube containing the passivating chemicals.

The test tube was then fitted with a stopper that was equipped with a nitrogen purging mechanism. The test tube was then placed in an oil bath heated to 120° C. and held at this temperature for six hours. The test tube was then removed and allowed to cool to room temperature under a constant nitrogen purge. The injector seats were then removed from the passivating chemicals and washed several times with heptane.

A needed number of injector seats were passivated. As mentioned previously the injector seat is that part of the injector that contains the nozzle that is susceptible to plugging or fouling due the formation of deposits. An equal number of identical non-passivated injectors were obtained to act as controls. The injectors were then constructed by Siemens VDO Automotive located in Newport News, Va. The constructed injectors were tested in a research DIG engine as described in patent applications WO 01/42398A1 and WO 01/42399A1.

Modifications to the engine included replacing one of the two spark plugs in each dual spark plug cylinder on the exhaust-side with prototype, pre-production high-pressure common rail direct injectors, removing the OEM (original equipment manufacturer) spark and fuel system, and installing a high-pressure fuel system and universal engine controller.

Table 1 summarizes the specifications of the modified test engine. For homogeneous combustion, flat-top pistons and the conventional gasoline spark ignition combustion chamber design were found to be sufficient for this type of research work. The injectors were located on the hot (i.e. exhaust) side of the engine to favor high tip temperatures to promote the formation of injector deposits.

The rate of injector (passivated and non-passivated) deposit formation was evaluated through the use of this specially developed steady-state engine test. Engine operating conditions for each test point were determined by measuring injector tip temperatures throughout the engine operating map range. Some of the injectors were fitted with thermocouples near the nozzle tip to measure the temperatures during the engine operating conditions. This technique is well known to those skilled in the automotive arts. Key engine parameters were inlet air and fuel temperatures, engine speed, and engine load. The inlet air and fuel temperatures were controlled at 35° C. and 32° C., respectively. The hydrocarbon fuel used in this test was gasoline that did not contain any additives.

TABLE 1

| Test Engine Specifications | |
|---|---|
| Type | Four Cylinder In-Line 2.2 Liter Nissan Engine Converted for DI (direct injection) Operation |
| Displacement | 2187 cubic centimeters |
| Plugs/cylinder | 1 (stock configuration: 2) |
| Valves/cylinder | 2 |
| Bore | 87 millimeters |
| Stroke | 92 millimeters |
| Fuel System | Common Rail High Pressure Direct Injection |
| Fuel Pressure | 6900 kPa (closed loop) |
| Engine Controller | Universal Laboratory System |
| Injection Timing | 300 degrees BTDC (before top dead center) |
| Coolant Temperature (° C.) | 85 |
| Oil Temperature (° C.) | 95 |

At constant inlet air/fuel temperature and engine load, injector tip temperature remained constant at engine speeds of 1500, 2000, 2500, and 3000 rpm (revolution per second). However, at constant engine speed, tip temperatures increase with load. For five load points, 200, 300, 400, 500, and 600 mg/stroke air charge, increasing tip temperatures of 120, 140, 157, 173, and 184° C., respectively, were observed for each load.

Through previous research, it was determined that a tip temperature of 173° C. provided optimum conditions for injector deposit formation in this engine. Table 2 sets forth the key test conditions used in performing the evaluation of the present invention.

TABLE 2

| Key Test Conditions | |
|---|---|
| Engine Speed (rpm) | 2500 |
| Inlet Air Temp. (° C.) | 35 |
| Inlet Fuel Temp. (° C.) | 32 |
| Exit Coolant Temp. (° C.) | 85 |
| Exit Oil Temp. (° C.) | 95 |
| Load (mg air/stroke) | 500 |
| Injector Tip Temp. (° C.) | 173 |

The test was divided into three periods: engine warm-up, an operator-assisted period, and test period. Engine speed was controlled using the engine dynamometer controller, and the engine throttle was manipulated to control air charge using a standard automotive airflow meter as feedback in a closed-loop control system.

Engine fueling was controlled in two ways. During warm-up, injector pulse width was controlled using a standard mass airflow strategy and exhaust gas sensor controlling the air/fuel mixture to stoichiometric levels. During the operator-assisted period, the pulse width was manually set for each injector using wide-range lambda sensors in the exhaust port of each cylinder. Fuel flow was measured using a volumetric flow meter and a temperature-corrected density value was used to calculate mass flow.

Each test was run at a load condition of 500 mg/stroke. This parameter is well known to those of skill in the art. Injector deposit formation was followed by measuring total engine fuel flow at fixed speed, air charge (mass of air per intake stroke), and the lambda signal from each cylinder over a test period of six hours. To help minimize injector-to-injector variability the same set of injectors was used for all tests at a particular engine load, with each injector always in the same cylinder.

Gasoline fuel compositions were subjected to the above-described engine tests whereby the substantial effectiveness of the passivation of the injector seat to within 0.1 mm of the injector nozzle demonstrated that deposit formations were reduced compared to non-passivated injectors.

The control and test injectors were then photographed under magnification. An examination of the photographs clearly demonstrated that deposit formation grows from outside of the injector nozzle and then into the injector nozzle. Based on this surprising discovery, it was concluded that passivation of the injector nozzle was unneeded. It was further concluded that passivation of the injector seat to within 0.1 to 2.0 mm of the injector nozzle would lessen the formation of deposits within the injector nozzle. It is the formation of deposits within the injector nozzle that causes the most damage to engine performance.

A further benefit provided herein is that passivation can be conducted in an earlier stage of injector construction. For example, the sheet metal from which the injector seats are constructed can be passivated and/or textured before the seats are cut from the sheet metal and then the nozzle drilled. This is very cost effective and simplifies the construction process of the injector. In contrast, conventional construction techniques for injectors requires that the seat be cut from the metal, then the nozzle is drilled and passivation is applied with emphasis on passivating the inside of the nozzle.

Thus the present further discloses a method for the construction of a fuel injector comprising a seat and a nozzle, the method or improvement comprising the steps of: a) passivating sheet metal; b) cutting said seat from said metal; c) drilling said nozzle in said seat; and d) assembling said injector.

It is to be understood that the reactants and components referred to by chemical name in the prior art and anywhere in the specification or claims hereof whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as a Mannich condensation reaction) or in forming a desired composition (such as an additive concentrate or an additive/fuel blend).

It should be appreciated that, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure and the prior art. The fact that the substance, components or ingredient may have lost its original identity through a chemical reaction or transformation during the course of such blending or mixing operations is thus wholly immaterial for an accurate understanding and appreciation of this disclosure and the claims thereof.

Fuel injectors and other substrates that can benefit from the present invention are typically constructed of any conventional material as well-known in the art. For example, such substrates may be stainless steel, corrosion-resistant alloys of nickel and chromium, high-strength, corrosion-resistant nickel-base alloys, and the like. It is these typical substrate materials which are susceptible to the formation of fuel thermal degradation products, such as gum, coke and/or sulfur compounds or mixtures thereof, in hydrocarbon fluids and fuels.

INDUSTRIAL APPLICABILITY

The automotive industry is constantly searching for ways to improve fuel economy, increase power per unit of fuel consumed, and reduce emissions. One technology of present interest is the direct injection gasoline (DIG) engine. The DIG engine, like diesel engines, can benefit from preventing or reducing deposit formation. The present invention is based in part on the discovery that the initial deposit occurs outside the injector nozzle or nozzle and then grows into the nozzle. More specially, the invention saves time, money and reduces deposit formation by applying a passivating chemical coating on the outside of the nozzle and/or by surface texturing, either by mechanically abrading or chemically etching the outside of the injector. In the case of fuel injectors the passivation is placed adjacent to and not in the nozzle. This advancement is used in conjunction with additives that are placed in the fuel to keep the passivated surface clean.

At numerous places throughout this specification, reference has been made to a number of U.S. patents and published foreign patent applications. All such cited documents are expressly incorporated in full into this disclosure as if fully set forth herein. This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A method for controlling deposit formation on at least one passivated metal part of an internal combustion engine, said method comprising the steps of introducing into said internal combustion engine a fuel composition comprising at least one fuel-soluble additive;

wherein the passivated metal part is subject to deposit formation, and further wherein the surface of the passivated metal part has unevenness thereon.

2. The method according to claim 1 wherein said additive comprises at least one additive selected from the group consisting of detergents, dispersants, antioxidants, carrier fluids, metal deactivators, dyes, markers, corrosion inhibitors, biocides, antistatic additives, drag reducing agents, demulsifiers, dehazers, anti-icing additives, antiknock additives, anti-valve-seat recession additives, lubricity additives, combustion improvers and mixtures thereof, and; at least one fuel-soluble cyclopentadienyl manganese tricarbonyl compound in proportions effective to reduce the weight of deposits in said internal combustion engine compared to a fuel that is devoid of a fuel-soluble cyclopentadienyl manganese tricarbonyl compound.

3. The method according to claim 2 wherein said cyclopentadienyl manganese tricarbonyl compound comprises at least one member selected from the group consisting of cyclopentadienyl manganese tricarbonyl, methylcyclopentadienyl manganese tricarbonyl and mixtures thereof.

4. The method according to claim 3 wherein said cyclopentadienyl manganese tricarbonyl compound is present in an amount sufficient to provide 0.0156 to 0.125 gram of manganese per gallon of fuel.

5. The method according to claim 1 wherein said metal part comprises a fuel injector.

6. The method according to claim 5 wherein said passivation is located on the outside of said injector and wherein said passivation comprises nano particles selected from the group consisting of alkali metals (Li, Na, K, Rb, etc), alkaline earth metals (Mg, Ca, Sr, Ba, etc), transition metals (Ti, Cr, Mn, Fe, Co, Ni, Cu, Zn, Zr, Mo, Ru, Rh, Pd, Hf, Ta, W, Re, Os, Ir, Pt, Ag, Au, etc) actinides and lanthanides (La, Y, Ac, Ce, Pr, Nd, Gd, Tb, etc), and mixtures thereof.

7. The method according to claim 6 wherein said outside of said injector does not comprise an injector nozzle.

8. The method according to claim 7 wherein said passivation is located within 0.1 to 2.0 mm of said injector nozzle.

9. The method according to claim 7 wherein said passivation is within 2.0 mm of said injector nozzle.

10. The method according to claim 1 wherein said engine is selected from the group consisting of direct injected gasoline (DIG) engines and compression ignited (diesel) engines.

11. The method according to claim 1 wherein said additive comprises at least one amine detergent.

12. The method according to claim 11 wherein the amine detergent comprises at least one member selected from the group consisting of hydrocarbyl-substituted succinic anhydride derivatives, Mannich condensation products, hydrocarbyl amines and polyetheramines.

13. A method for reducing deposit formation on the passivated fuel injectors of an injected internal combustion engine, said method comprises the step of introducing into said internal combustion engine a fuel composition comprising fuel-soluble additives, wherein the surface of the fuel injector has unevenness thereon, and further wherein said additive is at least one additive selected from the group consisting of antioxidants, carrier fluids, metal deactivators, dyes, markers, corrosion inhibitors, biocides, antistatic additives, drag reducing agents, demulsifiers, dehazers, anti-icing additives, antiknock additives, anti-valve-seat recession additives, lubricity additives and combustion improvers.

14. The method according to claim 13 wherein said additive comprises at least one member selected from the group consisting of hydrocarbyl succinimides, hydrocarbyl succinamides, hydrocarbyl succinimide-amides, hydrocarbyl succinimide-esters, and mixtures thereof.

15. The method according to claim 13 wherein said additive comprises a carrier fluid selected from the group consisting of: 1) a mineral oil or a blend of mineral oils that have a viscosity index of less than about 120; 2) one or more poly-α-olefin oligomers; 3) one or more poly (oxyalkylene) compounds having an average molecular weight in the range of about 500 to about 3000; 4) one or more polyalkenes; 5) one or more polyalkyl-substituted hydroxyaromatic compounds and 6) mixtures thereof.

16. The method of claim 15 wherein the carrier fluid comprises at least one poly (oxyalkylene) compound.

17. A method for reducing soot loading in the crankcase lubricating oil of a vehicle having a direct injection gasoline engine which comprises a passivated metal part, the method comprising the steps of introducing into said direct injection gasoline engine a fuel composition comprising: a) a fuel and b) a fuel-soluble additive;

wherein the passivated metal part is subject to deposit formation, and wherein the surface of the passivated metal part has unevenness thereon.

18. The method of claim 17 wherein the fuel composition comprises a cyclopentadienyl manganese tricarbonyl compound in proportions effective to reduce the amount of soot loading in the crankcase lubricating oil to below the amount of soot loading in said crankcase lubricating oil when said vehicle is operated in the same manner and on the same fuel except that the fuel is devoid of a fuel-soluble cyclopentadienyl manganese tricarbonyl compound.

* * * * *